US007846503B2

(12) United States Patent
Stark et al.

(10) Patent No.: US 7,846,503 B2
(45) Date of Patent: Dec. 7, 2010

(54) PROCESS AND ELECTROLYTES FOR DEPOSITION OF METAL LAYERS

(75) Inventors: Franz-Josef Stark, Zülpich (DE); Helmut Horsthemke, Solingen (DE); Ulrich Treuner, Solingen (DE)

(73) Assignee: Enthone Inc., West Haven, CT (US)

( * ) Notice: Subject to any disclaimer, the term of this patent is extended or adjusted under 35 U.S.C. 154(b) by 774 days.

(21) Appl. No.: 10/678,601

(22) Filed: Oct. 3, 2003

(65) Prior Publication Data

US 2004/0144285 A1 Jul. 29, 2004

(30) Foreign Application Priority Data

Oct. 4, 2002 (DE) ..... 102 46 453

(51) Int. Cl.
*C23C 18/36* (2006.01)
*C23C 18/50* (2006.01)
*B05D 1/18* (2006.01)

(52) U.S. Cl. ..... 427/345; 427/438; 427/443.1

(58) Field of Classification Search ..... 427/443.1
See application file for complete search history.

(56) References Cited

U.S. PATENT DOCUMENTS

| | | | | |
|---|---|---|---|---|
| 2,694,017 | A | 11/1954 | Reschan et al. | |
| 3,060,059 | A * | 10/1962 | Sickles | 427/438 |
| 3,597,266 | A | 8/1971 | Leibowitz et al. | |
| 3,597,267 | A | 8/1971 | Mallory et al. | |
| 3,876,434 | A * | 4/1975 | Dutkewych et al. | 106/1.27 |
| 3,887,732 | A * | 6/1975 | Parker et al. | 427/380 |
| 4,152,164 | A * | 5/1979 | Gulla et al. | 106/1.27 |
| 4,293,089 | A * | 10/1981 | McCormick et al. | 228/215 |
| 4,483,711 | A * | 11/1984 | Harbulak et al. | 106/1.22 |
| 5,080,982 | A * | 1/1992 | Yamamoto et al. | 428/844.2 |
| 5,258,061 | A * | 11/1993 | Martyak et al. | 106/1.22 |
| 5,925,415 | A * | 7/1999 | Fry et al. | 427/304 |
| 6,106,927 | A * | 8/2000 | Zhong et al. | 428/141 |
| 6,391,177 | B1 * | 5/2002 | Crotty | 204/529 |

FOREIGN PATENT DOCUMENTS

| | | | |
|---|---|---|---|
| DE | 1936391 | | 2/1970 |
| DE | 4032232 | A1 | 4/1991 |
| GB | 1243134 | | 8/1971 |
| GB | 2 231 063 | * | 11/1990 |
| GB | 2231063 | | 11/1990 |
| GB | 2237032 | A | 4/1991 |
| JP | 57-043978 | * | 3/1982 |
| JP | 5044048 | A | 2/1993 |
| JP | 6116734 | A | 4/1994 |
| JP | 2001214279 | A | 8/2001 |

OTHER PUBLICATIONS

Chen et al., "Internal Stress and Adhesion of Amorphous Ni—Cu—P Alloy on Aluminum", Thin Solid Films, Thin Solid Films, Jul. 17, 2000, vol. 370, Issues 1-2, pp. 106-113.
Abstract of JP6116734; Apr. 26, 1994.
Abstract of JP5044048; Feb. 23, 1993.
Abstract of JP2001214279; Aug. 7, 2001.

* cited by examiner

*Primary Examiner*—Katherine A Bareford
(74) *Attorney, Agent, or Firm*—Senniger Powers LLP

(57) ABSTRACT

The invention concerns an electrolyte for electroless deposition of metal layers with internal compressive stresses containing a metal base salt, a reducing agent, a complexing agent, an accelerator and a stabilizer. In order to make available an electrolyte of the said kind, from which uniform pore-free and crack-free metal-phosphorus coatings can be deposited with constant layers properties and high phosphorus contents at an elevated deposition rate over a long period of time, it is proposed by means of the invention that the electrolyte contain as metal base salt a metal salt whose anions contain at least one carbon atom and that is present in a starting concentration from 0.01 to 0.3 mol/L. At least one salt consisting of metal acetate, metal formate, metal oxalate, metal propionate, metal citrate and metal ascorbate, especially preferably metal acetate, is used as the metal salt whose anion contains at least one carbon atom. In addition, a method that is especially suitable for the use of the said electrolyte is proposed, where this method advantageously has a closed material circulation. Through the use of the invention especially pore-free and crack-free metal coatings with constant layer properties are uniformly deposited over a long time of use of the bath of at least 14-22 MTO.

17 Claims, No Drawings

PROCESS AND ELECTROLYTES FOR DEPOSITION OF METAL LAYERS

BACKGROUND OF THE INVENTION

This invention concerns an electrolyte for electroless deposition of metal layers with internal compressive stresses containing a metal base salt, a reducing agent, a complexing agent, an accelerator and a stabilizer, where preferably nickel, copper, silver or gold, especially preferably nickel, is used as metal.

Besides electrolytic methods for coating workpieces with a metal layer, the so-called noncurrent or currentless coating methods (electroless plating) have long been known. Electroless or chemical metalizing is understood to mean chemical surface treatment of nearly all metals and many nonconductors. This treatment differs in its chemical, physical and mechanical characteristics considerably from electrolytically deposited metal coatings. For example, it is advantageous that the chemical metal coating is produced uniformly in the deepest drillings and passages and, moreover, a layer thickness that is nearly constant and that follows contours more precisely is produced. This method is employed especially frequently for coating nonconducting substrates, for example plastic parts, in order to make them conductive, for example by means of a metallic surface, and/or to give them an attractive appearance. In the same way the material properties of the thus treated substrates can be improved by such methods. For instance, in each case according to the process, the corrosion resistance, hardness and/or wear resistance of the material can be improved.

Electroless coating with metals is based on an autocatalytic process, so that it is also called autocatalytic coating or plating. In order to reduce metal ions contained in the deposition bath (electrolyte) to elemental metal in such coating processes, an appropriate reducing agent that is itself oxidized during the reaction must be added to the electrolyte. Moreover, other components, for example phosphorus and/or additional metals like copper, etc. are often also incorporated into the coating.

Thus, metal coatings with a relatively high phosphorus content are produced in the case of an electroless metal bath through the use of hypophosphite as reducing agent. The corresponding reaction equation for this is as follows:

$$MSO_4+6NaH_2PO_2 \rightarrow M+2H_2+2P+4NaH_2PO_3+Na_2SO_4$$

Since the amount of phosphorus has a considerable effect on the properties of the coating, for example hardness and corrosion resistance, it is incorporated in a controlled way, in each case according to the purpose of the coated object. For example, a phosphorus fraction of ≧10 wt % is desired in the case of nonmagnetic coatings with maximum hardness. Moreover, such electroless deposited metal-phosphorus coatings have higher hardness and better wear resistance than electrolytically deposited coatings.

Hypophosphite-containing baths for electroless deposition of metals, however, tend to become unstable during the deposition, since the concentration of the metal and hypophosphite ions continuously decreases with progressive metal plating, while the concentration of orthophosphite ions continuously increases and the counterions of the metal and hypophosphite ions, in the form of sodium sulfate, for example, increase in concentration. The electrolyte in this way becomes "spent."

The lifespan of such electroless baths is thus limited, since the electrolyte can be used only for a certain number of coating runs with uniform coating results. The age of a bath is usually given in terms of metal turnover (MTO), where 1 MTO is equal to the amount of metal deposited from the bath. This corresponds to the originally introduced concentration of metal ions in the bath, in each case with respect to the total volume of the bath. In the case of the methods that are currently known in the prior art the degradation products in the electrolyte reach a concentration after 5 to 10 MTO that is so high that a high deposition rate as well as a uniformly high quality of the deposited metal can no longer be guaranteed. The electrolyte must then either be replaced or regenerated by means of appropriate agents.

However, the necessary disposal of the spent baths and the necessary recharging of fresh baths leads, disadvantageously, to high costs and considerable environmental stress.

The regeneration of an electrolyte for nickel deposition means at least the removal of the orthophosphite ions that have been formed as reaction products and optionally the addition of metal or hypophosphite ions. In the known methods the troublesome components are separated from the bath, for example, by means of adsorption on ion exchange resins or by electrodialytic processes. Such processes do enable a considerably longer bath life time, but for the most part they involve very high operating costs because of the complex apparatus, etc.

Another less costly method of regeneration of baths for electroless deposition of metals is the in situ deposition and separation of undesired ions in the form of sparingly soluble compounds and the subsequent makeup of ions that are necessary and that are consumed in the course of the bath service life. However, for the most part only rare metals, which are very expensive, are possibilities as precipitation agents. In addition, the components of these additions that remain dissolved in the bath have an adverse affect on the quality of the metal coating.

In addition, there are already known methods in which troublesome deposits of metal orthophosphite can be prevented through the addition of complexing agents, and in this way the stability of the baths can be considerably improved through the targeted reduction of the concentration of dissolved free nickel ions. In the past many different types of bath additives have been proposed, but they all had the disadvantage that uniform, pore-free and firmly adhering deposition of metal-phosphorus coatings is not possible over a long period of time from such baths at an economically acceptable deposition rate of 7-10 μm/h and with internal compressive stresses at a phosphorus content of the coating of >10%. Usually the lifetime of such baths is 7 to a maximum of 10 MTO, where no $S^{2-}$-containing accelerators are used.

SUMMARY OF THE INVENTION

The invention is based on the task of specifying an electrolyte for electroless deposition of metals, from which uniform, pore-free and crack-free metal-phosphorus coatings with constant layer properties and high phosphorus contents can be deposited at an elevated deposition rate over a long period of time. The metals used in this case are preferably nickel, copper, silver or gold, especially preferably nickel. In addition, an electrolyte with high stability and lifetime, which contains complexing agents and stabilizers that are effective in a wide range of volumes and that contribute considerably to increasing the deposition rate and to increasing the service life of the bath, is to be made available. Another task of this invention is to make available a method for electroless deposition of metals, preferably nickel, copper, silver or gold, especially preferably nickel.

DETAILED DESCRIPTION OF THE PREFERRED EMBODIMENT

The task is solved in accordance with the invention by means of an electrolyte for electroless deposition of metal layers, preferably nickel, copper, silver or gold, especially preferably nickel with internal compressive stresses, containing a metal base salt, a reducing agent, a complexing agent, an accelerator and a stabilizer, by the fact that the electrolyte contains as metal base salt a metal salt whose anions are volatile and that has a starting concentration from 0.01 to 0.3 mol/L. This metal salt, whose anions are volatile, is preferably at least a salt consisting of metal acetate, metal formate, metal nitrate, metal oxalate, metal propionate, metal citrate and metal ascorbate, preferably metal acetate.

Through the electrolyte in accordance with the invention the disadvantages known in the prior art are remedied by making available a new electrolyte composition, and in this way considerably better deposition conditions are achieved, through which the conduct of the process becomes simpler and more economical. This is chiefly due to the advantageous composition of the electrolyte. In particular, through the use of metal salts whose anions are volatile, preferably metal acetates, as electrolyte base salt, it is possible to increase the service life of the electrolyte considerably with high deposition rates and uniformly deposited layers with constant layer properties.

The electrolyte in accordance with the invention is basically composed with one or more metal base salts, preferably a metal acetate, and a reducing agent, preferably sodium hypophosphite. In addition, various additives such as complexing agents, accelerators and stabilizers, which are advantageously used in acid electrolytes for electroless deposition of nickel, are added to the electrolyte. Since the deposition rate is considerably higher in an acid environment, preferably an acid is added as complexing agents to the electrolyte. The use of carboxylic acids and/or polycarboxylic acids proved to be particularly advantageous, since on the one hand this results in advantageous solubility of the metal salts and targeted control of the free metal ions and, for another it presets the pH value or facilitates its adjustment that is necessary for the process, based on its acid strength. The pH of the electrolyte advantageously lies in the range of 4.0-5.2. In addition, the dissolved metal can be complexly bound with particular advantage through the use of carboxylic acids and/or polycarboxylic acids, their salts and/or derivatives, preferably hydroxy(poly)carboxylic acids, especially preferably 2-hydroxypropanoic acid and/or propanedioic acid. At the same time these compounds serve as activators and as pH buffers and through their advantageous properties make a considerable contribution to the stability of the bath.

Advantageously, a sulfur-containing heterocycle is added to the electrolyte as accelerator. Preferably saccharine, its salts and/or derivatives, especially preferably sodium saccharine, is used as sulfur-containing heterocycle. In contrast to the $S^{2-}$-based accelerators that are known and usually used in the prior art, the addition of a saccharate, even in higher concentrations, does not have an adverse effect on the corrosion resistance of the deposited metal layers. Another important prerequisite for a rapid as well as qualitatively high grade deposition of metal layers is the use of suitable compounds for stabilizing the electrolytes. A number of different stabilizers is known in the prior art. However, since the stability of the electrolyte in accordance with the invention is considerably affected by the use of metal salts whose anions are volatile, chiefly the acetates, formates, nitrates, oxalates, propionate, citrate and ascorbate of the metals, especially preferably metal acetate, advantageously only small amounts of stabilizer are used. This is more economical for one thing, and for another deposits that can arise through the addition of additional substances and thus considerably shorten the service life of the electrolyte are avoided. Thus, only small amounts of a stabilizer are advantageously added to the electrolyte in accordance with the invention in order to counteract spontaneous decomposition of the metal plating bath. These can be, for example, metals, halogen compounds and/or sulfur compounds such as thioureas. Here the use of metals as stabilizers proved to be particularly advantageous. Preferred in this case is the use of lead, bismuth, zinc and/or tin, which are especially preferably in the form of a salt whose anion contains at least one carbon atom. These salts are preferably one or more salts from the group consisting of acetates, formates, nitrates, oxalates, propionates, citrates and ascorbates, especially preferably acetates.

In each case according to which additional properties the metal layers are supposed to have, other components such as additional metals, preferably cobalt, and/or finely dispersed particles can be incorporated into the layer in addition to phosphorus. In addition, the electrolyte in accordance with the invention has smaller amounts of additional components such as salts, preferably potassium iodide.

With regard to the present task it is solved by means of a method for electroless deposition of metal layers with internal compressive stresses from an electrolyte containing a metal base salt, a reducing agent, a complexing agent, an accelerator and a stabilizer, where preferably nickel, copper, silver or gold, especially preferably nickel, is used as metal, where that uniform metal layers are deposited at a steady high deposition rate in the range of at least 7 to 12 μm/h with a throughput of at least 14 to 22 MTO (=70 to 110 g Ni/L) from the electrolyte that contains as metal base salt a metal salt whose anions are volatile and that has a starting concentration from 0.01 to 0.3 mol/L. Preferably at least one salt from the group consisting of the acetates, nitrates, formates, oxalates, propionates, citrates and ascorbates of the metals, especially preferably a metal acetate, is used as the metal salt whose anions are volatile.

Surprisingly, the quality of the metalizing bath is improved and its service life considerably increased through the use of the method in accordance with the invention. This advantageously has the result that through the use of the method in accordance with the invention not only are high deposition rates achieved, but also that the nickel layers produced by the method are uniform and qualitatively high grade, have very good adhesion and are absolutely pore-free and crack-free. In addition, the metalizing of the surface especially of complex substrates is improved. In particular, it is advantageous that uniform nickel layers with internal compressive stresses are deposited at a steady high deposition rate in the range of at least 7 to 14 μm/h, preferably 9 to 12 μm/h, with a throughput of at least 14 to 22 MTO=70 to 110 g Ni/L.

Surprisingly, deposition of high grade metal-phosphorus layers with phosphorus contents above 10% is possible under the same process conditions. The advantageous use of the method in accordance with the invention in many different areas results from this. For example, the corrosion-resistant metal layers deposited in accordance with the invention are suitable for coating keys or locks, valves, tube and pipe fittings, etc. Due to the high phosphorus fraction the layer becomes nonmagnetic and therefore is excellently suitable for coating electrical plugs and contacts as well as housings for electronic devices, etc. Because of their very good wear resistance the coatings produced by the method in accordance with the invention are preferably used in the field of mechanical engineering for coating wear surfaces, couplings, pump housings, etc.

As already stated, the method suggested with the invention is characterized in particular by the composition of the electrolyte. In addition, it is environmentally friendly in advantageously economical way, in contrast to the traditional methods. The electrolyte in accordance with the invention can be regenerated by means of electrodialysis processes, for example. When using metal salts whose anions are volatile, the separating effect of the electrodialysis unit becomes significantly higher. In the case of electrolytes that contain orthophosphite ions but not sulfate ions the number of electrolysis cells for separation of orthophosphite ions can be reduced for the same separating power, if the salt load is the same.

At the beginning of the process the base electrolyte of the electrolyte in accordance with the invention is prepared. It contains, for example in the case of nickel plating, essentially the following composition:

| | |
|---|---|
| 4-6 g/L | Nickel ions |
| 25-60 g/L | Reducing agents |
| 25-70 g/L | Complexing agents |
| 1-25 g/L | Accelerators |
| 0.1-2 mg/L | Stabilizers |
| 0-3 g/L | Other components. |

The pH range of such a base electrolyte lies between 4.0 and 5.0. As already described above, metal salts whose anions are volatile are advantageously used as metal recipient. One or more salts from the group consisting of metal acetates, metal formates, metal nitrates, metal oxalates, metal propionates, metal citrates, and metal ascorbates, especially preferably only metal acetate, are used as metal salts. Since during the reaction the pH decreases due to the continuous formation of H+ ions and it must be kept in the set range in a costly way by means of alkali media such as a hydroxide, carbonate or, as is usually preferred, by ammonia, there is particular advantage in the sole use of metal salts whose anions are volatile and that preferably derive from the group consisting of the acetates, formates, nitrates, oxalates, propionates, citrates and ascorbates. This is based on the fact that in the deposition of the metal-phosphorus layers anions of the acetates, formates, nitrates, oxalates, propionates, citrates and ascorbates are formed, which react with the sodium cations from the sodium hypophosphite to form basic sodium salts. The electrolyte in accordance with the invention thus operates during the entire deposition process in a pH range from 4.0 to 5.2, preferably 4.3 to 4.8, without having to add large amounts of alkali media. Because of the extremely advantageous pH self-regulation it is possible to avoid continuous monitoring of pH as well as the addition of alkali additives.

The starting concentration of the metal base salt is 0.04 to 0.16 mol/L, preferably 0.048 to 0.105 mol/L, with respect to nickel, where the content of metal is between 0.068 and 0.102 mol/L, preferably 0.085 mol/L.

Preferably, sodium hypophosphite with a concentration of 25 to 65 g/L is used as reducing agent.

As was already illustrated, carboxylic acids and/or polycarboxylic acids, their salts and/or derivatives, preferably hydroxy(poly)carboxylic acids, especially 2-hydroxypropanoic acid and/or propanedioic acid are used as complexing agents. Through the use of these compounds the dissolved nickel becomes complexly bound in an especially advantageous way, so that by means of continuous addition of such complexing agents the deposition rate can be kept in a corresponding interval of 7 to 14 μm/h, preferably 9 to 12 μm/h. The starting concentration of the complexing agent in the base electrolyte is between 25 and 70 g/L, preferably 30 to 65 g/L.

The starting concentration of the accelerator, where preferably a sulfur-containing heterocycle, especially preferably saccharine, its salts and/or derivatives, really especially sodium saccharine, is used, is 1 to 25 g/L preferably 2.5 to 22 g/L. A halogen compound and/or sulfur compound, preferably thiourea, can be used as stabilizers. However, the use of metals, preferably lead, bismuth, zinc and/or tin, especially preferably in the form of the salts whose anions are volatile, is especially advantageous. These salts preferably derive from the group consisting of acetates, formates, nitrates, oxalates, propionates, citrates and ascorbates. The nitrates of the metals that are used as stabilizers are really especially preferred. The starting concentrations of the stabilizers is advantageously 0.1 to 2 mg/L, preferably 0.3 to 1 mg/L.

Optionally, other components, for example potassium iodide in a starting concentration from 0 to 3 g/L, can be added to the base electrolyte.

Many different substrates can be introduced into this base electrolyte and plated. To support the service life and the stability of the electrolyte it can be regenerated during the deposition process by means of electrodialysis and/or ion exchange resins. In the same way it is possible to add makeup solutions (as indicated below) to the electrolyte during the deposition process. These makeup solutions are specially composed to regulate the individual contents of the base components and are added in different amounts to the electrolyte.

A first makeup solution includes, for example, the following composition:

| | |
|---|---|
| 500-580 g/L | Reducing agent |
| 5-15 g/L | Complexing agent |
| 50-150 g/L | Alkaline buffer |
| 11-20 g/L | Accelerator |
| 0-3 g/L | Other components. |

Advantageously, the same substances are used in the preparation and use of the makeup solution as in the base electrolyte. From this results another very important advantage of the method in accordance with the invention. Since the same substances are always used and nearly no contaminants and precipitants are formed, even the compounds from the rinse can be re-added to the electrolyte. The method in accordance with the invention thus has closed material circulation which additionally allows the method to be conducted more economically and in a more environmentally friendly way. The content of complexing agent and the content of alkaline buffer is chosen so that an increase to a total content of complexing agents in the electrolyte to 70 to 90 g/L takes place if one takes into account possible entrainment losses of a maximum of 40%.

At the same time the content of the accelerator in the electrolyte is controlled so that, for example in the case of a nickel electrolyte and when using sodium saccharate as accelerator, between 0.100 and 0.200 g, preferably 0.150 g, is made up per gram of deposited nickel, taking into account the entrainment losses. With this a continuous rise to 7.5-15 g/L is ensured at the same time.

The following composition, for example, can be used as second makeup solution:

| | |
|---|---|
| 10-50 g/L | Complexing agent |
| 0.68-2.283 mol/L | Metal recipient |
| 1-25 g/L | Accelerator |
| 40-80 mg/L | Stabilizer. |

Here the complexing agents of the second makeup solution can be the same as in the first makeup solution or a different complexing agent, in each case according to requirements. For example, at 60 g/L hydroxycarboxylic acid, for example 2-hydroxypropanoic acid, one can additionally use a hydroxycarboxylic acid, for example propanedioic acid, in a content of 0.5 g/L, as a second complexing agent in the base electrolyte. Then the content of the propanedioic acid can be increased by 0.005 to 0.015 g/g of the deposited nickel by supplying the makeup solution, where the entrainment losses are taken into account. Through the continuous rise of propanedioic acid from 0.5 g/L to about 1.2 g/L at 16 MTO, equal to 80 g Ni/L, the deposition rate is maintained in the set interval.

Deposition of adherent metal layers with internal compressive stresses up to a throughput of at least 14 MTO is ensured with such an approach as well as with the pertinent makeup solution when using metal sulfate in addition to the metal base salts described previously. If metal base salts whose anions have at least one carbon atom and are preferably derived from the groups of the acetates, formates, oxalates, propionates, citrates and ascorbates, are used by themselves, the service life of the electrolytes surprisingly rises up to 22 MTO. The already noted internal compressive stresses here are extremely important and very desirable property of the layer. They have a favorable effect on the bending fatigue stress and they increase the ductility. For example, in the case of nickel, metal layers with ductility of >+0.5% are deposited. In the same way the internal compressive stresses have a favorable effect on the corrosion resistance of the metal-phosphorus layers.

In addition, other components such as additional metals, preferably copper, and/or finely divided particles, for example thermoplastics or duroplastics that contain fluorine, can be added to the electrolyte or the makeup solutions, so as to achieve additional hardness, dry-lubricant effects, and/or other properties in the deposited layers.

For a detailed presentation of the invention, a preferred embodiment of the electrolyte in accordance with the invention is described in the following example, to which the invention is, however, not restricted.

Example 1:

| Composition | Electrolyte | Makeup solution RA | Makeup solution SA |
|---|---|---|---|
| Nickel acetate 4-hydrate (g/L) | 12.5-25.5 | / | 200-212 |
| Sodium hypophosphite (g/L) | 30-50 | 515-565 | / |
| Hydroxycarboxylic acid (g/L) | 32-55 | / | 25-35 |
| Hydroxypolycarboxylic acid (g/L) | 0.5-5 | / | / |
| Sodium saccharine (g/L) | 2.5-22 | 12.5-15 | / |
| Potassium iodide (g/L) | 0.1-1 | 1-2 | / |
| Lead acetate (mg/L) | 0.3-1 | / | 60-65 |
| Ammonia, 25 wt % | 100-150 | | |

-continued

Example 1:

| Composition | Electrolyte | Makeup solution RA | Makeup solution SA |
|---|---|---|---|
| (mL/L) | | | |

Such an electrolyte has a self-regulating pH range of 4.3 to 4.8 and enables deposition rates of 8 to 1 μm/h. The internal stress of the layers thus deposited is −10 to −40 N/mm$^2$. When the said electrolyte composition is used metal-phosphorus layers with stable good properties, especially internal compressive stresses, are deposited at a throughput of 22 MTO, equal to 110 g Ni/L.

By increasing the pH range to 4.6-5.2 layers with internal compressive stresses from 0 to −15 N/mm$^2$ are deposited. The establishment of a second pH interval leads to a significant increase of the deposition rate to 12-20 μm/h. The phosphorus content of these layers is 8-10% P. Through a further increase of the pH region to 5.5-6.2 layers with internal compressive stress from −5 to −30 N/mm$^2$ are deposited. The phosphorus content of these layers is 2-7% P.

The invention claimed is:

1. A method for electroless deposition of a nickel-phosphorus layer with internal compressive stress on a substrate, the method comprising:

contacting the substrate with an electrolyte buffered to a self-regulating pH between 5.5 and 6.2 and consisting essentially of:

nickel acetate in an initial concentration between 0.048 mol/L to 0.105 mol/L, a hypophosphite reducing agent, a complexing agent comprising 2-hydroxypropanoic acid and propanedioic acid, an accelerator, a stabilizer comprising a metal salt wherein the metal is selected from the group consisting of lead, bismuth, zinc, tin, and combinations thereof and the metal salt comprises an anion selected from the group consisting of acetate, formate, nitrate, oxalate, propionate, citrate, ascorbate, and combinations thereof, and is present in a starting concentration of 0.1 to 2 mg/L , and optionally other components selected from the group consisting of phosphorus, additional metals, and finely divided particles;

to thereby electrolessly deposit the nickel-phosphorus layer with internal compressive stress on the substrate, wherein the nickel-phosphorus layer comprises between 2 to 7 wt. % phosphorus, and the nickel-phosphorus layer comprising between 2 and 7 wt. % phosphorus is deposited with internal compressive stress between −5 and −30 N/mm$^2$ and is deposited with ductility >$^+$0.5% throughout a throughput of 14 to 22 MTO for a total nickel concentration throughput between 70 g/L nickel and 110 g/L nickel.

2. The method of claim 1, wherein a first makeup solution is added to the electrolyte during electroless deposition, wherein the first makeup solution comprises a reducing agent, an accelerator, an alkaline buffer, and a complexing agent selected from the group consisting of 2-hydroxypropanoic acid, propanedioic acid, and a combination thereof.

3. The method of claim 2 wherein the complexing agent in the first makeup solution comprises 2-hydroxypropanoic acid and propanedioic acid.

4. The method of claim 3 wherein the complexing agent concentration is between about 70 g/L and about 90 g/L after the first makeup solution is added to the electrolyte during electroless deposition.

5. The method of claim 2, wherein a second makeup solution is added to the electrolyte while practicing the method, wherein the second makeup comprises an accelerator, a stabilizer, and a complexing agent selected from the group consisting of 2-hydroxypropanoic acid, propanedioic acid, and a combination thereof.

6. The method of claim 5 wherein the complexing agent in the second makeup solution comprises 2-hydroxypropanoic acid and propanedioic acid.

7. The method of claim 1, wherein the reducing agent is sodium hypophosphite.

8. The method of claim 1 wherein the accelerator is a sulfur-containing heterocycle.

9. The method of claim 1 wherein:

the nickel acetate yields a starting concentration of 4-6 g/L nickel ions;

the reducing agent has a starting concentration of 25-60 g/L;

the complexing agent has a starting concentration of 25-70 g/L;

the accelerator has a starting concentration of 1-25 g/L.

10. The method of claim 9 wherein a first makeup solution is added to the electrolyte during electroless deposition, wherein the first makeup solution comprises a reducing agent, an accelerator, an alkaline buffer, and a complexing agent comprising 2-hydroxypropanoic acid and propanedioic acid.

11. The method of claim 10 wherein the complexing agent concentration is between about 70 g/L and about 90 g/L after the first makeup solution is added to the electrolyte during electroless deposition.

12. The method of claim 9 wherein:

the complexing agent starting concentration is 30 to 65 g/L;

the accelerator starting concentration is 2.5 to 22 g/L; and the stabilizer starting concentration is 0.3 to 1 mg/L.

13. The method of claim 12 wherein a first makeup solution is added to the electrolyte during electroless deposition, wherein the first makeup solution comprises a reducing agent, an accelerator, an alkaline buffer, and a complexing agent comprising 2-hydroxypropanoic acid and propanedioic acid.

14. The method of claim 13 wherein the complexing agent concentration is between about 70 g/L and about 90 g/L after the first makeup solution is added to the electrolyte during electroless deposition.

15. The method of claim 1 wherein the substrate is a plastic part.

16. A method for electroless deposition of a nickel-phosphorus layer with internal compressive stress on a substrate, the method comprising:

contacting the substrate with an electrolyte buffered to a self-regulating pH between 4.3 and 4.8 and consisting essentially of:

nickel acetate in an initial concentration between 0.048 mol/L to 0.105 mol/L, a hypophosphite reducing agent, a complexing agent comprising 2-hydroxypropanoic acid and propanedioic acid, an accelerator, a stabilizer comprising a metal salt wherein the metal is selected from the group consisting of lead, bismuth, zinc, tin, and combinations thereof and the metal salt comprises an anion selected from the group consisting of acetate, formate, nitrate, oxalate, propionate, citrate, ascorbate, and combinations thereof, and is present in a starting concentration of 0.1 to 2 mg/L, and optionally other components selected from the group consisting of phosphorus, additional metals, and finely divided particles;

to thereby electrolessly deposit the nickel-phosphorus layer with internal compressive stress on the substrate, wherein the nickel-phosphorus layer is deposited with internal compressive stress between −10 $N/mm^2$ and −40 $N/mm^2$ and is deposited with a ductility $>^{+}0.5\%$ throughout a throughput of 14 to 22 MTO for a total nickel concentration throughput between 70 g/L nickel and 110 g/L nickel.

17. A method for electroless deposition of a nickel-phosphorus layer with internal compressive stress on a substrate, the method comprising:

contacting the substrate with an electrolyte buffered to a self-regulating pH between 4.6 and 5.2 and consisting essentially of:

nickel acetate in an initial concentration between 0.048 mol/L to 0.105 mol/L, a hypophosphite reducing agent, a complexing agent comprising 2-hydroxypropanoic acid and propanedioic acid, an accelerator, a stabilizer comprising a metal salt wherein the metal is selected from the group consisting of lead, bismuth, zinc, tin, and combinations thereof and the metal salt comprises an anion selected from the group consisting of acetate, formate, nitrate, oxalate, propionate, citrate, ascorbate, and combinations thereof, and is present in a starting concentration of 0.1 to 2 mg/L, and optionally other components selected from the group consisting of phosphorus, additional metals, and finely divided particles;

to thereby electrolessly deposit the nickel-phosphorus layer with internal compressive stress on the substrate, wherein the nickel-phosphorus layer comprises between 8 and 10 wt.% phosphorus and the nickel layer comprising between 8 and 10 wt.% phosphorus is deposited with internal compressive stress between 0 and 15 $N/mm^2$ and is deposited with ductility $>^{+}0.5\%$ throughout a throughput of 14 to 22 MTO for a total nickel concentration throughput between 70 g/L nickel and 110 g/L nickel.

* * * * *

UNITED STATES PATENT AND TRADEMARK OFFICE

CERTIFICATE OF CORRECTION

PATENT NO. : 7,846,503 B2
APPLICATION NO. : 10/678601
DATED : December 7, 2010
INVENTOR(S) : Franz-Josef Stark et al.

It is certified that error appears in the above-identified patent and that said Letters Patent is hereby corrected as shown below:

Column 10, Claim 17, Line 54: “0 and 15” should read -- 0 and -15 --.

Signed and Sealed this
First Day of February, 2011

David J. Kappos

David J. Kappos
*Director of the United States Patent and Trademark Office*